United States Patent [19]

Kagiura et al.

[11] 4,421,401

[45] Dec. 20, 1983

[54] IMAGE RECORDING APPARATUS

[75] Inventors: Kazuo Kagiura, Tokyo; Hiroyuki Miyake, Inagi; Nobuhiro Kasama, Yokohama; Seiji Sagara, Kawasaki; Nobukazu Sasaki, Tokyo; Takaji Yonemori, Kawasaki, all of Japan

[73] Assignee: Canon Kabushiki Kaisha, Tokyo, Japan

[21] Appl. No.: 262,955

[22] Filed: May 12, 1981

[30] Foreign Application Priority Data

May 16, 1980 [JP] Japan ..... 55-65710

[51] Int. Cl.[3] ..... G03G 15/20

[52] U.S. Cl. ..... 355/3 FU; 355/3 SH; 355/14 FU; 432/60

[58] Field of Search ..... 355/3 R, 3 FU, 3 SH, 355/14 FU; 432/60, 228

[56] References Cited

U.S. PATENT DOCUMENTS

| | | | |
|---|---|---|---|
| 3,331,592 | 7/1967 | Cassano et al. | 432/60 |
| 3,794,417 | 2/1974 | Machmer | 355/3 FU |
| 3,951,538 | 4/1976 | Bar-on | 355/3 R |
| 4,110,068 | 8/1978 | Brown et al. | 432/60 |
| 4,154,575 | 5/1979 | Edwards et al. | 355/3 FU X |

*Primary Examiner*—Fred L. Braun

*Attorney, Agent, or Firm*—Fitzpatrick, Cella, Harper & Scinto

[57] ABSTRACT

An image fixing device having at least a pair of rotatable members for fixing a toner image on an image supporting material. In order to provide a simple structure in which the image supporting material can be readily and positively removed during jamming or the like, the apparatus includes a discharge device selectively shiftable between a normal position and a temporal retracted position, a first power transmitting member for applying a driving force to one of the rotatable members, a second power transmitting member for applying a driving force from a source of power to the first power transmitting member, cooperating elements for positioning the first and second power transmitting members selectively at an operative position in which the members cooperate to transmit the driving force and at an inoperative position in which the first power transmitting member is separated from the second power transmitting member, and a manually operable member for rotating at least one of the pair of rotatable members.

23 Claims, 5 Drawing Figures

IMAGE RECORDING APPARATUS

BACKGROUND OF THE INVENTION

1. Field of the Invention

This invention relates to an apparatus for recording information in the form of toner images such as, for example, electrophotographic devices, electrostatic recording devices of magnetic photographing devices.

2. Description of Prior Art

In such image recording devices, a fixing device is generally used which has at least a pair of rollers for carrying an image supporting material having a toner image formed thereon, said toner image being fixed during carrying. When the nip between the rollers is jammed with the image supporting material, the latter can be removed from the jammed nip by manually rotating the pair of rollers or by drawing the pair of rollers out of the housing of the image recording apparatus. However, such operations have been complicated and cumbersome.

SUMMARY OF THE INVENTION

It is a primary object of the present invention to provide a fixing device having a simple structure in which such jammed image-supporting material can be readily and positively removed.

According to the present invention, an image recording apparatus has a fixing device having at least a pair of rotatable members for fixing a toner image on an image supporting material and, in order to provide a simple structure in which the image supporting material can be readily and positively removed during jamming or the like, includes discharge means selectively shiftable between a normal position and a temporal position retracted from said normal position, a first power transmitting member for applying a driving force to one of said rotatable members, a second power transmitting member for applying a driving force from a source of power to said first power transmitting member in response to the shift in said discharge means, co-operating means for positioning said first and second power transmitting members selectively at an operative position in which said first and second power transmitting members co-operates to transmit said driving force and at an inoperative position in which said first power transmitting member is separated apart from said second power transmitting member, and manually operating means for rotating at least one of said pair of rotatable members.

In such an apparatus, furthermore, removing of any jamming material and repairing, replacing or cleaning of fixing rollers can be easily accomplished.

DESCRIPTION OF THE PREFERRED EMBODIMENTS

Embodiments of this invention will now be described with reference to the drawings.

Figure 1:
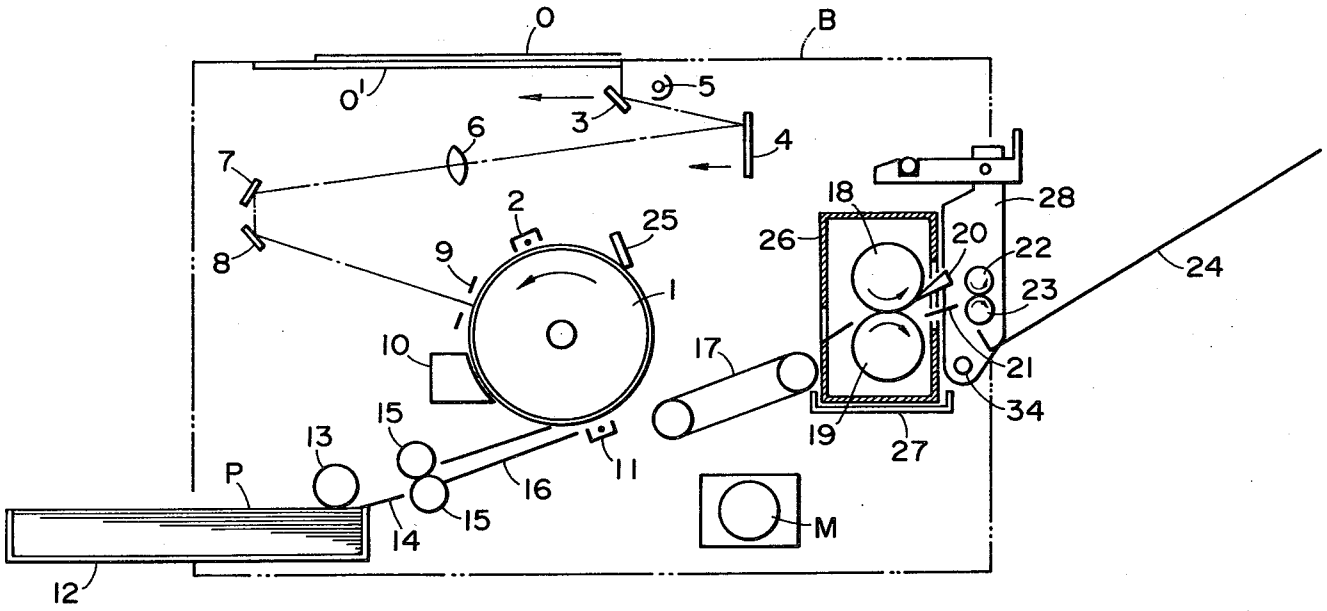
FIG. 1 is a cross-sectional view of the main part of an electrophotographic copying machine to which the present invention can be applied.

FIG. 1 is a schematic view showing an embodiment of this invention. In this figure, reference numeral 1 designates a photosensitive drum rotated in a direction shown by an arrow, the peripheral surface thereof having an electrophotographic photoreceptor formed thereon. As the drum 1 is rotated, it is first charged uniformly by a corona discharger 2 and then subjected to slit-exposure based on the optical image on an original to be copied O through a slit 9. Thus, an electrostatic latent image corresponding to the original O is formed on the drum 1.

The original O is placed on a platen O′ of glass and scanned by mirrors 3 and 4 which are moved in such a direction as shown by arrows at speed ratio of 1:½. During this scanning, the original is illuminated by an illuminant 5 which is moved together with the mirror 3. The scanned original O is imaged by a lens 6 from which the imaging light beam is reflected by stationary mirrors 7 and 8 to be incident upon the drum 1 through said slit 9.

Said latent image is developed by a developing device 10 to form a toner image which is in turn transferred to a sheet of paper P under the action of a transfer charger 11. The paper P is delivered from a delivery cassette 12. A supply of sheets of such paper are placed in the delivery cassette 12 and forwarded one by one by means of a delivery roller 13. The forwarded paper is fed to the nip between timing rollers 15 through a guide plate 14. The timing rollers 15 are adapted to drive the paper in a timed relation to the scanning of an original, so that the paper is fed to a transfer position while being guided by a guide plate 16. In the transfer position, the toner image is transferred to the paper as above-mentioned. After transfer, the paper P is separated from the drum 1 and then fed to a fixing device by means of a belt 17. The fixing device includes a fixing roller 18 having a source of heat located therein and a pressure roller 19 engaging with the fixing roller under pressure. These rollers 18 and 19 are rotated in directions shown by the respective arrows to move the paper by the nip therebetween. At this time, the toner-image supporting surface of the paper P is pressed against the roller 18 so that the toner image will be fused by heat from the roller 18 to be fixed to the paper P. After passing through the nip between the rollers 18 and 19, the paper P is conducted into the nip between discharge rollers 22 and 23 by means of such an arrangement that is composed of a separating pawl 20 having its tip which is in contact with the periphery of the roller 18 for separating the paper P therefrom, and a guide plate 21 located opposed to the pawl 20 to define a passage for paper. The rollers 22 and 23 are rotated in directions shown by the respective arrows to receive the paper P from the nip between the rollers 18 and 19 at the nip between the rollers 22, and to 23 and move the paper to a collecting tray 24 into which the paper is discharged.

The toner remaining on the drum 1 after transfer can be cleaned by means of a cleaner 25 so that the drum 1 can be again used in the next image forming process.

The above-mentioned measures are disposed within a housing B of the copying machine on the top of which the platen O′ is mounted. The rollers 18 and 19 can be removed from the housing B after the front door (not shown) thereof has been opened. Further, the rollers 18 and 19 can be again mounted in position in the box-like body B.

More particularly, the rollers 18 and 19 are disposed within a casing 26 of the fixing device which is slidably supported by a guide member 27 fixedly mounted in the housing B at an immovable position. When a supporting plate 28 described hereinafter is moved from its normal position to a temporal position, the casing 26 can be drawn out of the housing B in the opposite direction from the viewer as viewed in the plane of FIG. 1 under the guidance of a guide member 27 which is fixed to the copying machine.

When it is desired to repair or replace the rollers 18 and 19 and to remove any jammed paper from between these rollers, the casing 26 may be drawn out of its normal position within the machine in which the rollers 18 and 19 are positioned in the path of the paper P fed by the belt 17 for performing the fixation as aforementioned.

The drum 1, mirrors 3 and 4, rollers 13, 15, 18, 19, 22 and 23, and belt 17 are driven from a motor M through chain sprockets, clutches and gear trains, etc., not shown.

Figure 2:
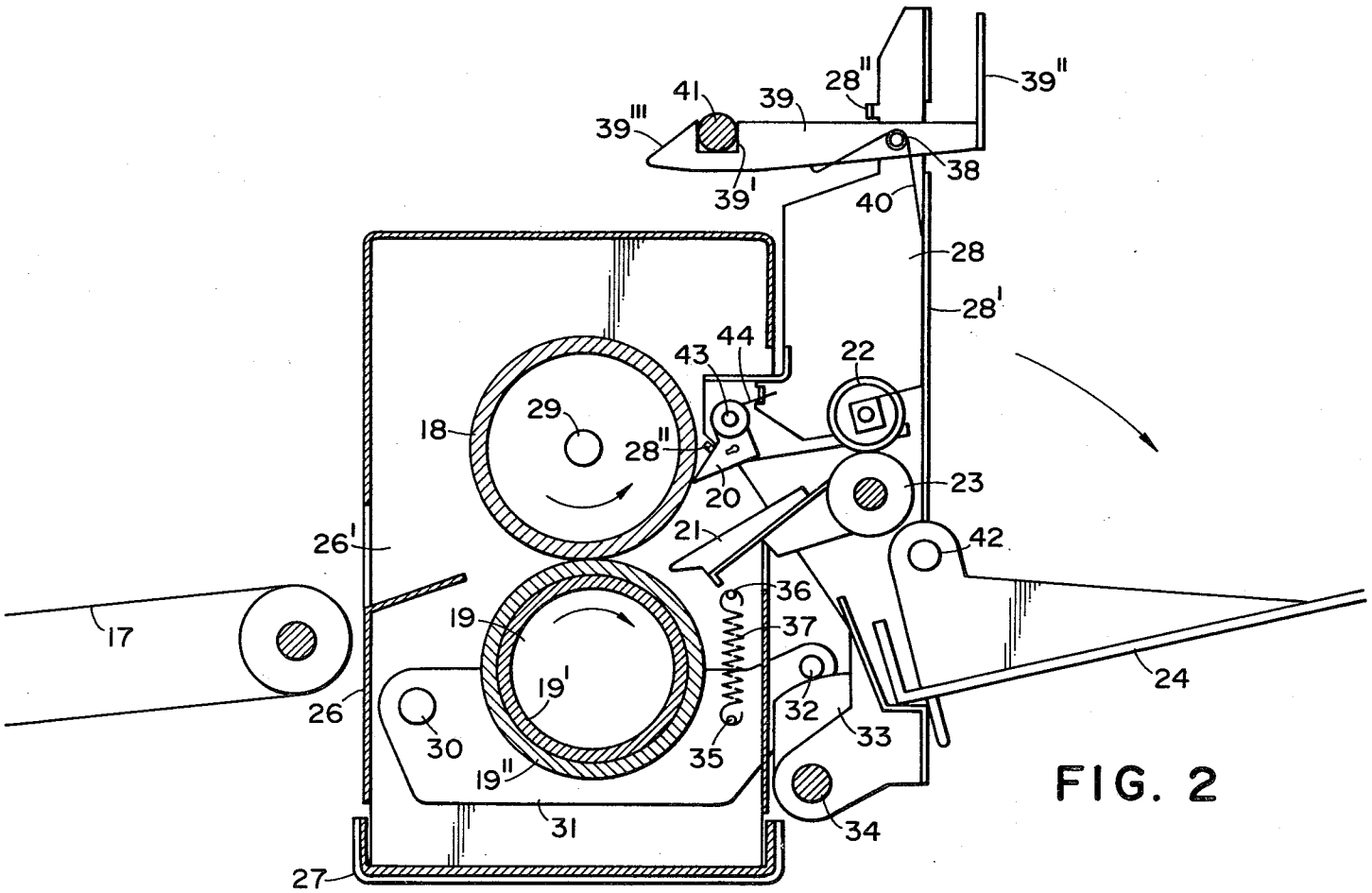
FIGS. 2 through 4 are cross-sectional views illustrating the main part of an embodiment according to the present invention.

FIG. 2 is a view showing the details of the embodiment in FIG. 1. The fixing roller 18 is a rigid metal pipe having its outer periphery coated with a thin film of antioffsetting material such as ethylene tetrafluoride resin or the like. The fixing roller 18 also includes a hollow internal portion in which a heater 29 is disposed for heating the fixing roller 18 up to such a temperature that the toner can be fused and fixed.

The roller 19 comprises a rigid metal core roll 19' and a thick coating 19'' of elastic anti-offsetting material such as silicone rubber which is applied around the core roll 19'. In such a position (operative position) as shown in FIG. 2, the roller 19 is engaged by the roller 18 under pressure so that the elastic coating layer 19'' will be brought to its elastic deformation to form an area having a width in the moving direction of the paper P at the nip between the rollers 18 and 19. Thus, the paper can be put between the rollers 18 and 19 under pressure for such a period of time that is required to accomplish the fixation depending upon the speed at which the rollers 18 and 19 are rotated by the motor M. As will be described hereinafter, the rotational driving force is transmitted from the motor M to a gear 45 fixed to the shaft of the fixing roller 18. The roller 19 is driven by the roller 18 under the friction therebetween.

The roller 18 is rotatably supported at its operative position by means of side plates 26' constituting the fixing device casing 26 while the pressure roller 19 is rotatably supported by means of a lever 31 which is in turn swingably supported by a shaft 30 on the side plates 26'. The lever 31 has a pin 32 mounted thereon at the opposite end to the shaft 30 with respect to the roller 19. This pin 32 rides on a cam 33 which is mounted on the discharge-roller supporting plate 28. The supporting plate 28 is swingably supported by means of a shaft 34 which is mounted on the stationary portion of the copying machine. Therefore, even if the fixing device casing 26 is drawn out of the copying machine, the supporting plate 28 remains in the machine. In such a manner, the supporting plate 28 can be pivoted from its normal position shown in FIG. 2 clockwise through angle of about 90 degrees. When the supporting plate 28 is so moved to its temporal position, the cam 33 also is pivoted away from the pin 32 so that the lever 31 will be pivoted clockwise about the shaft 30. As a result, the roller 19 is moved downward from the position shown in FIG. 2 to release the contact between the rollers 18 and 19 under pressure. Although the rollers 18 and 19 may completely be separated from each other, it is preferred that the rollers 18 and 19 are slightly engaged by each other under the above released condition at a pressure less than that in the FIG. 2 state, for example, in such a manner that said elastic deformation in the elastic layer 19'' of the roller 19 can substantially be eliminated. For this purpose, a pin 35 is provided on the lever 31 while a pin 36 is located on the side plate 26'. A spring 37 is located between the pins 35 and 36. When the cam 33 is pivoted away from the pin 32, the lever 31 is resiliently supported only by the spring 37 to slightly engage the roller 19 with the roller 18.

When the supported plate 28 is returned from the temporal position to the normal position shown in FIG. 2, the cam 33 is engaged by the pin 32 to pivot the lever 31 counter-clockwise. At the normal position of the supporting plate 28, the roller 19 will be in contact with the roller 18 under the desired pressure. In the illustrated embodiment, the pressure between the rollers 18 and 19 can be reduced only by manually pivoting the supporting plate 28 from its normal position to its temporal position for eliminating any jamming of paper in the fixing section and for repairing or replacing the rollers. This provides an extremely simple structure compared to the prior art structure in which the roller 18 is engaged or disengaged with the roller 19 at each passage of paper or each actuation of the copying machine.

In the upper portion of the supporting plate 28 is provided a pin 38 about which a hook 39 is swingably supported. The hook 39 is engaged by one end of a torsion spring 40 the other end of which abuts on the turned portion 28' of the supporting plate 28. As a result, the hook 39 tends to be pivoted clockwise, but is limited by means of a protrusion 28'' formed in the supporting plate 28. The hook 39 includes a notch 39' formed therein which is engaged by a stationary rod 41 in the housing B of the copying machine when the supporting plate 28 is in the normal position of FIG. 2, thereby holding the supporting plate 28 at its normal position. To pivot the supporting plate 28 to its temporal position, the turned plate portion 39'' of the hook 39 is simply pushed by the operator so that the hook 39 will be pivoted counter-clockwise against the action of the spring 40 to disengage the notch 39' with the stationary rod 41. As a result, the supporting plate 28 can be pivoted clockwise. To return the supporting plate 28 from the temporal position to the normal position, it may be pivoted counter-clockwise simply by manually moving the turned plate portion 28' thereof toward the copying machine. The hook 39 has a camming surface 39''' formed in the tip thereof which is first engaged by the bottom face of the stationary rod 41 in the above pivoting of the supporting plate 28 so that the hook 39 will be guided to pivot counter-clockwise resulting in the engagement between the notch 39' and the rod 41.

The discharge rollers 22 and 23 are rotatably supported by the supporting plate 28 at position. The tray 24 also is mounted on the supporting plate 28 by means of a shaft 42. Further, the supporting plate 28 includes the guide plate 21 fixed thereto and the separating pawl 20 pivotably mounted on the supporting plate 28 by means of a shaft 43 which is provided in the supporting plate 28. The separating pawl 20 is engaged by one end of a torsion spring 44 the other end of which is mounted on the supporting plate 28. Under the influence of this torsion spring 44, the separating pawl 20 tends to be pivoted clockwise, thereby resiliently engaging the tip of the pawl 20 with the roller 18 when the supporting plate 28 is in its normal position. As the supporting plate 28 is moved toward its temporal position, the pawl 20 is moved away from the roller 18. At this time, the clockwise movement of the pawl 20 is limited by means of a protrusion 28″ in the supporting plate 28.

Figure 3:
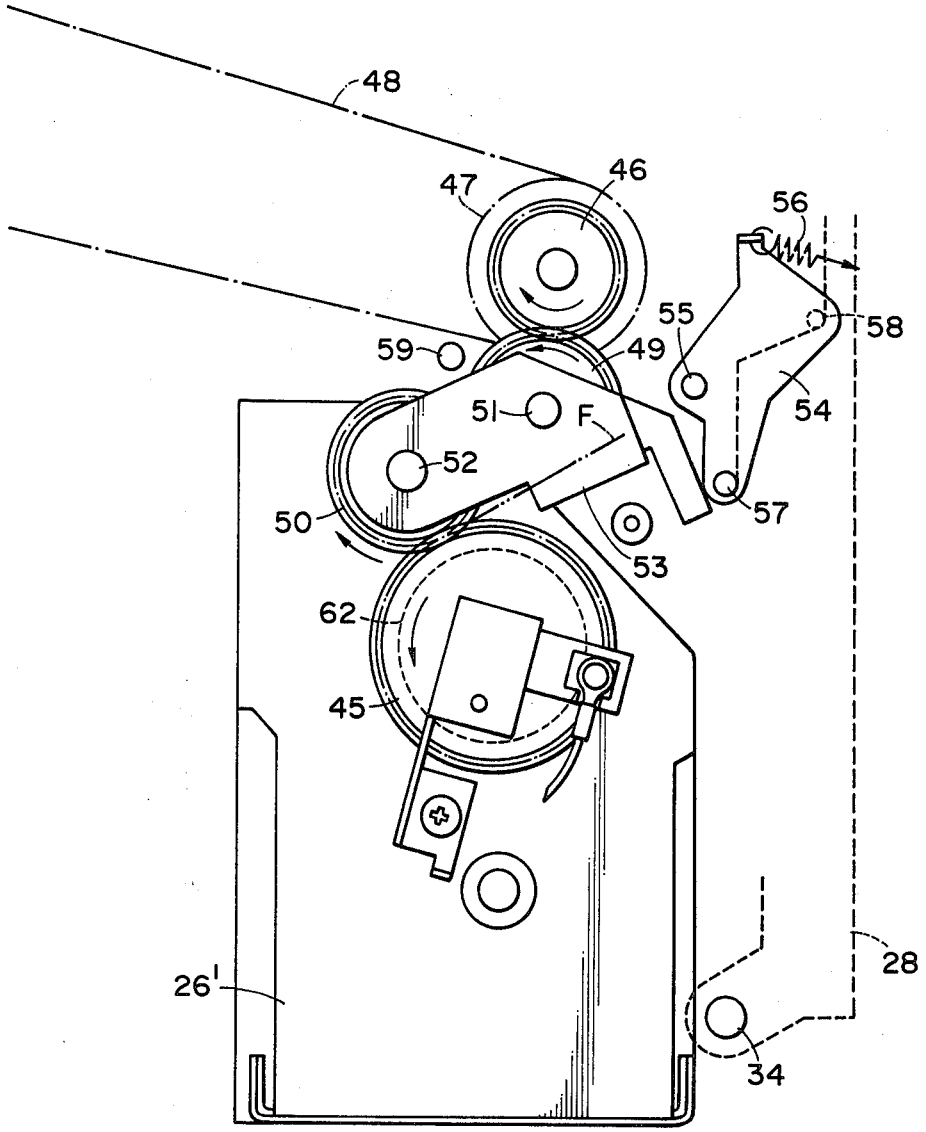
Figure 4:
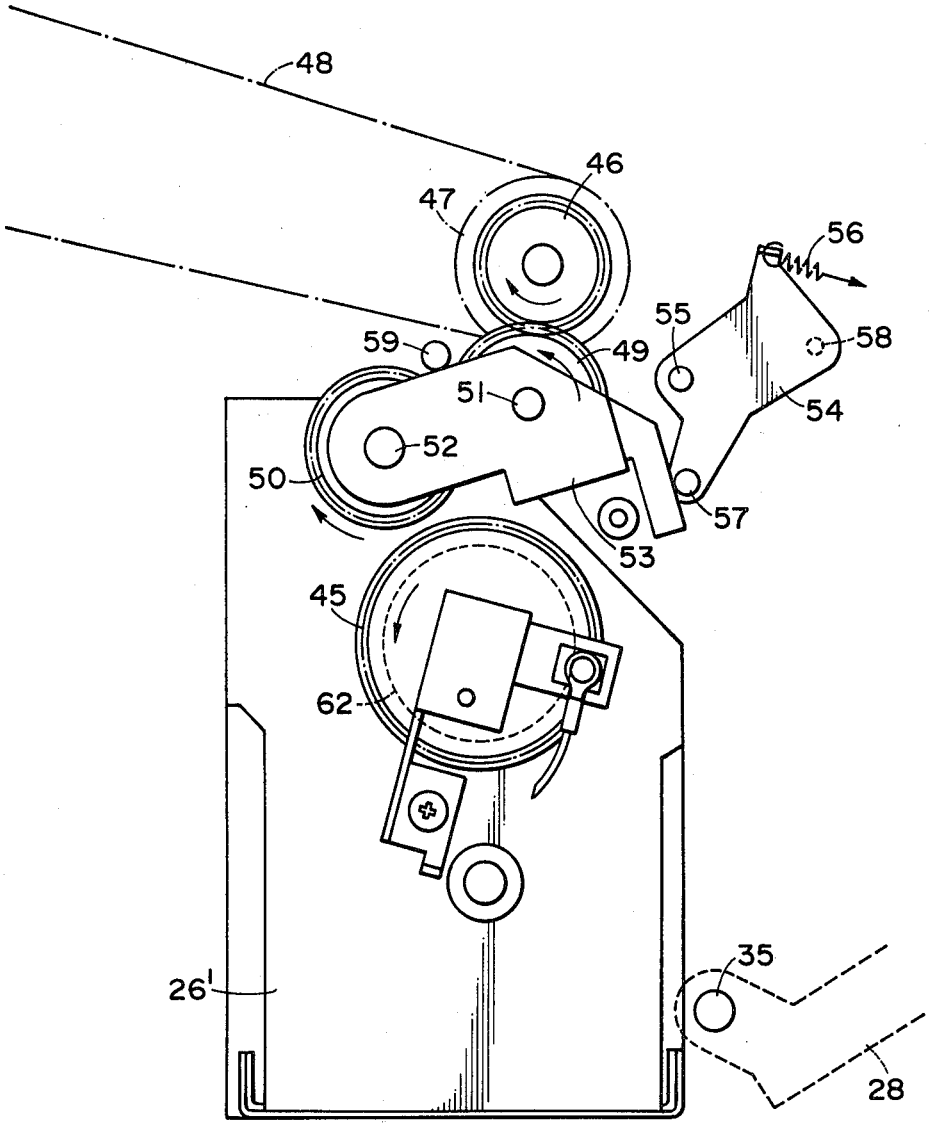

The driving mechanism for the rollers 18 and 19 will now be described. Referring to FIGS. 3 and 4, reference numeral 45 denotes a gear mounted on the shaft of the fixing roller 18. Reference numeral 46 designates a gear which is rotatably supported in the housing B of the copying machine and which includes a sprocket 47 mounted integrally thereon. A chain 48 is passed around the sprocket 47 for transmitting the rotational driving force from the main motor M to the sprocket 47 so that the gear 46 will be rotated. The rotation of the gear 46 is transmitted to the gear 45 through idle gears 49 and 50. Namely, the gear 49 engages with the gear 46 and the gear 50 engages with the gear 49. Further, the gear 50 engages with the gear 45. The gear 50 is rotatably supported by a shaft 52 on a swingable arm 53 which is mounted around a shaft 51 supported by the stationary portion of the copying machine housing B. Accordingly, even if the fixing device casing 26 is drawn out of the copying machine, the gears remain in the machine. The shaft 51 also supports the gear 49 rotatably.

In such a state as shown in FIG. 3, that is, when the supporting plate 28 is in its normal position, the arm 53 tends to pivot counter-clockwise around the shaft 51 under the influence of gravity so that the gear 50 will be engaged by the gear 45.

On the other hand, a swingable arm 54 is mounted around a shaft 55 which is supported by the stationary portion of the copying machine housing B. The arm 54 is engaged at one end by a spring 56 the other end of which is mounted on the stationary portion of the copying machine housing B. As a result, the arm 54 tends to pivot clockwise. The arm 54 includes a pin 57 mounted thereon at the opposite end to the spring 56 with respect to the shaft 55 and a pin 58 thereon at the same end as the spring 56 with respect to the shaft 55. When the supporting plate 28 is in its normal position, the upper side wall of the supporting plate 28 engages with the pin 58 to hold the arm 54 at the position shown in FIG. 3 against the resilient force of the spring 56. At this time, the pin 57 is in a position spaced apart from the arm 53. When the supporting plate 28 is moved to its temporal position, however, the pin 58 is released from the supporting plate 28 so that the arm 54 will be pivoted clockwise under the influence of the spring 56. As a result, the pin 57 engages with an end portion of the arm 53 to pivot the arm 53 clockwise so that the gear 50 will be moved away from the gear 45 as shown in FIG. 4. As the arm 53 is pivoted clockwise through a predetermined extent of angle, it is stopped by a stopper 59 (see FIG. 4).

When the supporting plate 28 is turned to its normal position, the upper side wall thereof abuts against the pin 58 to urge it in such a manner that the arm 54 is pivoted counter-clockwise against the resilient force of the spring 56, thereby also pivoting the arm 53 counter-clockwise under the influence of gravity to engage the gear 50 with the gear 45.

The pivotal point 51 of the arm 53 is positioned at a location opposite to the gear 45 with respect to a common tangent on the respective pitch circles in the gears 45 and 50. In other words, where one assumes a vector of the reaction which is received by the gear 50 from the gear 45 as the gears 45 and 50 are rotated in engagement, the above pivotal point 51 is positioned at a location opposite to the gear 45 with respect to an imaginary line F extending from the engagement point between the gears 45 and 50 in the direction of the above vector. This imaginary line F will be called a reaction line for simplification. Consequently, the gear 50 can positively be engaged by the gear 45 under a moment around the shaft 51 due to the above reaction if the gear 50 receives the driving force from the motor M and transmits it to the gear 45, in spite of the fact that the gear 50 is swingable about the pivotal point 51. Therefore, the gear 45 can positively and regularly be driven so that fixed images having better quality will be obtained.

Figure 5:
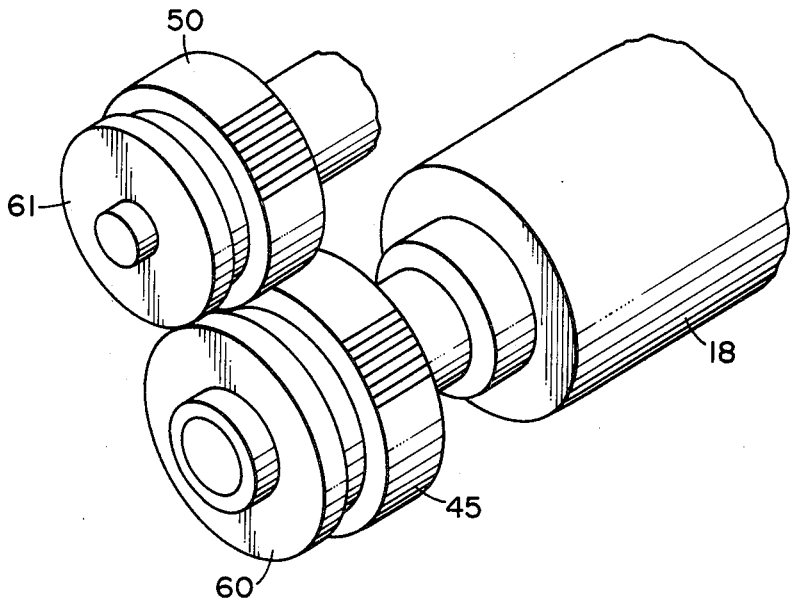
FIG. 5 is a perspective view of the main part of the embodiment shown in FIGS. 2 through 4.

As shown in FIG. 5, the gear 45 includes a disc 60 mounted integrally and coaxially thereon whereas the gear 50 also includes a disc 61 mounted similarly thereon. When the gears 45 and 50 are engaged by each other as shown in FIG. 3 to provide a predetermined space between the shafts of the gears 45 and 50, the disc 60 is engaged by the disc 61. As the gears 45 and 50 are rotated, these discs 60 and 61 also are rotated in engagement at the same angular speed as those of the gears. Under the engagement between the discs 60 and 61, any jamming between the gears 50 and 45 can be avoided even if said moment exists in this region.

In FIGS. 3 and 4, reference numeral 62 designates a manually operating knob which is mounted on the shaft of the roller 18 at the opposite end to the gear 45.

Now, if the nip between the rollers 18 and 19 is jammed with a sheet of paper P during the operation of the copying machine, such jamming is detected by any well known detecting means to cut off the power to the motor M. When the front door of the housing B is thereafter opened and then the supporting plate 28 is moved to its temporal position as described hereinbefore, the pawl 20, the guide 21 and the discharge rollers 22, 23 all of which have been positioned downstream of the rollers 18 and 19 with respect to the advancing direction of paper are retracted from the path of paper to provide a free space downstream of the rollers 18 and 19.

At this time, the pressure roller 19 is displaced downward as aforementioned to be held in the slight engagement with the fixing roller 18. If said knob 62, which may be mounted also on the roller 19, is rotated manually by the operator, the roller 18 is rotated in the direction shown by the arrow and at the same time the roller 19 is driven to rotate under the friction between the rollers 18 and 19. As a result, the jamming paper P will be fed downstream with respect to the advancing direction of paper from the nip between the rollers 18 and 19. In such a manner, the paper can be readily removed from the above free space. At this time, since the roller 19 is not completely spaced apart from the roller 18, the paper is in contact with the roller 18 and therefore receives the remaining heat from the roller 18 so that the toner image thereon will be fused to fix it to the paper.

It is noted that the knob 62 can be easily rotated manually because the gear 50 is held spaced away from the gear 45 and the roller 19 is slightly engaged by the roller 18 as described hereinbefore.

If the jamming paper should not be able to be removed even by the above operation or when it is desired to repair or replace the rollers 18 and 19, the fixing device casing 26 containing the rollers 18 and 19 would be drawn out of the copying machine housing along the guide member 27. This drawing-out operation can be readily accomplished since the gear 50 is spaced apart from the gear 45 without any interference therebetween. For the same reason, the re-mounting of the fixing device casing 26 can be similarly readily achieved after the necessary measures have been taken. After the re-mounting, the supporting plate 28 is returned back to its normal position so that the gear 50 will be positively engaged by the gear 45 to smoothly transmit the driving force.

Although the gear 45 engaging with the gear 50 has been described to be mounted on the shaft of the fixing roller 18 in the above embodiment, the gear 45 may be mounted on the shaft of the pressure roller 19. Further, the manual operation knob 62 may be attached to the shaft of the pressure roller 19 rather than that of the fixing roller 18.

From the description of the preferred embodiments, it is understood that the present invention provides a fixing device having a simple structure in which any jammed image-supporting material can be readily and positively removed without any damage to rollers.

What we claim is:

1. An image recording apparatus comprising:

imaging means for forming a toner image corresponding to information to be recorded on an image supporting material;

first and second rotatable members, having a nip therebetween, for fixing said toner image while carrying said image supporting material in said nip;

a first power transmitting member mechanically connected with said first rotatable member for rotating the same when said first power transmitting member is driven;

a second power transmitting member shiftable between an operative position in which said second power transmitting member co-operates with said first power transmitting member and an inoperative position in which said second power transmitting member is separated apart from said first power transmitting member, said second power transmitting member being adapted to transmit a driving force from a source of power to said first power transmitting member when said second power transmitting member is in said operative position;

discharge means selectively shiftable between a normal position in which the image supporting material fed from the nip between said first and second rotatable members is discharged by said discharge means and a temporal position in which said discharge means is retracted from said normal position;

cooperating means for transmitting the shift movement in said discharge means to said second power transmitting member, said cooperating means being adapted to shift said second power transmitting member between said operative and inoperative positions correspondingly when said discharge means is shifted between said normal and temporal positions; and a manually operable member mechanically connected to at least one of said first and second rotatable members to allow manual rotation of at least one of said first and second rotatable members.

2. An image recording apparatus comprising:

imaging means for forming a toner image corresponding to information to be recorded on an image supporting material;

first and second rotatable members, having a nip therebetween, for fixing said toner image while carrying said image supporting material in said nip;

a first power transmitting member mechanially connected with said first rotatable member for rotating the same when said first power transmitting member is driven;

a second power transmitting member shiftable between an operative position in which said second power transmitting member cooperates with said first power transmitting member and an inoperative position in which said second power transmitting member is separated apart from said first power transmitting member, said second power transmitting member being adapted to transmit a driving force from a source of power to said first power transmitting member when said second power transmitting member is in said operative position;

discharge means shiftable selectively between a normal position in which the image supporting material fed from the nip between said first and second rotatable members is discharged by said discharge means and a temporal position in which said discharge means is retracted from said normal position;

first cooperating means for transmitting the shift movement in said discharge means to said second power transmitting member, said first cooperating means being adapted to shift said second power transmitting member between said operative and inoperative positions correspondingly when said discharge means is shifted between said normal and temporal positions;

means for supporting one of said first and second rotatable members in such a manner that said one rotatable member can be shifted between an engagement position in which said one rotatable member is engaged by the other rotatable member under a predetermined pressure and a contact position in which said one rotatable member is engaged by the other rotatable member under a pressure less than said predetermined pressure;

second cooperating means for transmitting the shift movement in said discharge means to said one rotatable member, said second cooperating means being adapted to shift said one rotatable member between said engagement and contact positions correspondingly when said discharge means is shifted between said normal and temporal positions; and a manually operable member mechanically connected to at least one of said first and second rotatable members, to allow manual rotation of at least one of said first and second rotatable members.

3. An image recording apparatus comprising:

imaging means for forming a toner image corresponding to information to be recorded on an image supporting material;

first and second rotatable members, having a nip therebetween, for fixing said toner image while carrying said image supporting material in said nip;

a first power transmitting member mechanically connected with said first rotatable member for rotating the same when said first power transmitting member is driven;

a second power transmitting member shiftable between an operative position in which said second power transmitting member is engaged by said first power transmitting member and an inoperative position in which said second power transmitting member is separated apart from said first power transmitting member, said second power transmitting member being adapted to transmit a driving force from a source of power to said first power transmitting member when said second power transmitting member is in said operative position;

discharge means shiftable selectively between a normal position in which the image supporting material fed from the nip between said first and second rotatable members is discharged by said discharge means and a temporal position in which said discharge means is retracted from said normal position;

first cooperating means for transmitting the shift movement in said discharge means to said second power transmitting member, said first cooperating means being adapted to shift said second power transmitting member between said operative and inoperative positions correspondingly when said discharge means is shifted between said normal and temporal positions;

means for supporting one of said first and second rotatable members in such a manner that said one rotatable member can be shifted between an engagement position with said one rotatable member, under pressure, and a release position in which said one rotatable member is separated away from the other rotatable member;

second cooperating means for transmitting said shift movement in said discharge means to said one rotatable member, said second cooperating means being adapted to shift said one rotatable member between said engagement and release positions correspondingly when said discharge means is shifted between said normal and temporal positions; and a manually operable member mechanically connected to at least one of said first and second rotatable members to allow manual rotation of at least one of said first and second rotatable members.

4. The image recording apparatus as defined in any one of claims 1 to 3 wherein said first and second rotatable members can be drawn out of said image recording apparatus together when said discharge means is in said temporal position, and further including guide means in said image recording apparatus for conducting said first and second rotatable members during drawing-out, and wherein, when said first and second rotatable members are drawn out of said image recording apparatus, said first power transmitting member is also drawn out together with said first rotatable member, while said second power transmitting member is retained in said image recording apparatus.

5. The image recording apparatus as defined in claim 4, in which said discharge means is mounted on a swingable supporting member which is manually pivoted around a given central axis located at a stationary position within said image recording apparatus, wherein said discharge means will not interfere with said first and second rotatable members when they are being drawn out of or inserted into said image recording apparatus, and further comprising a switching member, supported on said discharge means supporting member, for manually switching between the fixing and the swinging of said discharge means supporting member with respect to said apparatus, and a member, fixed on said recording apparatus, for engagement with said switching member.

6. The image recording apparatus as defined in any one of claims 1 to 3 wherein said second power transmitting member is mounted on a swingable support member which is pivoted around a given central axis.

7. The image recording apparatus as defined in claim 6 wherein the central axis around which said swingable support member is pivoted is positioned at a location opposed to said first power transmitting member with respect to a line of a reaction force which is received by said second power transmitting member from said first power transmitting member when said second power transmitting member is in said operative position.

8. The image recording apparatus as defined in claim 6 wherein said first and second rotatable members can be drawn out of said image recording apparatus together when said discharge means is in said temporal position, and further including guide means in said image recording apparatus for conducting said first and second rotatable members during drawing-out, and wherein the central axis around which said swingable support member is pivoted is located at a stationary position within said image recording apparatus in which said axis will not be interfered with by said first and second rotatable members when they are being drawn out of or inserted into said image recording apparatus, and wherein, when said first and second rotatable members are drawn out of said image recording apparatus, said first power transmitting member is also drawn out together with said first rotatable member, while said second power transmitting member is retained in said image recording apparatus.

9. The image recording apparatus as defined in claim 8 wherein said discharge means is mounted on a swingable discharge means supporting member which is manually pivoted around a given central axis, wherein said given axis is located at a stationary position within said image recording apparatus so that said axis will not be interfered with by said first and second rotatable members when they are being drawn out of or inserted into said image recording apparatus.

10. The image recording apparatus as defined in claim 9, wherein said cooperating means for transmitting the shift movement to said second power transmitting member includes a rotatable interrelating member having a first engaging portion engageable with said second power transmitting member supporting member and a second engaging portion engageable with said discharge means supporting member, said interrelating member having a rotation axis which is fixed in said recording apparatus.

11. The image recording apparatus as defined in claim 9, further comprising a switching member, supported on said discharge means supporting member, for manually switching between the fixing and the swinging of said discharge means supporting member with respect to said apparatus, and a member, fixed on said recording apparatus, for engagement with said switching member.

12. An image recording apparatus comprising:

imaging means for forming a toner image corresponding to information to be recorded on an image supporting material;

first and second rotatable members, having a nip therebetween, for fixing said toner image while carrying said image supporting material in said nip;

a first power transmitting member mechanically connected with said first rotatable member for rotating the same when said first power transmitting member is driven;

a second power transmitting member shiftable between an operative position in which said second power transmitting member cooperates with said first power transmitting member and an inoperative position in which said second power transmitting member is separated from said first power transmitting member, said second power transmitting member being adapted to transmit a driving force from a source of power to said first power transmitting member when said second power transmitting member is in said operative position;

a manually operable member mechanically connected to at least one of said first and second rotatable members to allow manual rotation of at least one of said first and second rotatable members; and means for moving, when said first and second rotatable members are in said recording apparatus, said second power transmitting member from said operative position to said inoperative position to allow the manual rotation.

13. An image recording apparatus comprising:

imaging means for forming a toner image corresponding to information to be recorded on an image supporting material;

first and second rotatable members, having a nip therebetween, for fixing said toner image while carrying said image supporting material in said nip;

a first power transmitting member mechanically connected with said first rotatable member for rotating the same when said first power transmitting member is driven;

a second power transmitting member shiftable between an operative position in which said second power transmitting member cooperates with said first power transmitting member and an inoperative position in which said second power transmitting member is separated from said first power transmitting member, said second power transmitting member being adapted to transmit a driving force from a source of power to said first power transmitting member when said second power transmitting member is in said operative position;

means for detachably attaching said first and second rotatable member on said recording apparatus; and means for moving said second power transmitting member to said operative position and said inoperative positon to allow the detachment and attachment of said attaching means, whereupon said first power transmitting member is drawn out of said apparatus together with said first rotatable member, while said second power transmitting member is retained in said recording apparatus.

14. The apparatus as defined in claim 12 or 13, wherein said moving means includes a cover which can be opened and closed with respect to said apparatus, in response to which said second power transmitting member is moved to said operative and inoperative positions.

15. The apparatus as defined in claim 14, further comprising means for displacing at least one of said first and second rotatable members in response to the closing and opening of said cover.

16. The apparatus as defined in claim 15, wherein said cover is rotatably supported on a shaft fixed on said apparatus, and supports a member for guiding the image supporting material which has passed through the nip.

17. The apparatus as defined in claim 14, wherein said cover is rotatably supported on a shaft fixed on said apparatus, and supports a member for guiding the image supporting material which has passed through the nip.

18. The apparatus as defined in claim 12 or 13, further comprising means for displacing at least one of said first and second rotatable members in response to the movement of said second power transmitting member by said moving means.

19. The apparatus according to any one of claims 1, 2, 3, 12 or 13 wherein said first and second power transmitting members include gears.

20. An image recording apparatus comprising:

imaging means for forming a toner image corresponding to information to be recorded on an image supporting material;

first and second rotatable members, having a nip therebetween, for fixing said toner image while carrying said image supporting material in said nip;

a supporting member, detachably mounted on said apparatus, for urging said first and second rotatable member into pressure contact;

a movable member for rotatably supporting a member for transporting the image supporting member which has passed through the nip, said movable member being movable relative to said first and second rotatable member to take first and second positions;

means for allowing said detachable supporting member to be drawn out of the apparatus in response to movement of said movable member; and a first power transmitting member for rotating one of said first and second rotatable members, a second power transmitting member for transmitting a driving power to said first power transmitting member, and means for engaging said second power transmitting member with said first power transmitting member and disengaging said second power transmitting member from said first power transmitting member in response to movement of said movable member.

21. The apparatus according to claim 20, wherein said movable member supports a member for separating the image supporting material from said first rotatable member.

22. The apparatus according the claim 20, wherein said movable member supports a member for guiding the image supporting material from said first and second rotatable members to said transport member.

23. The apparatus according to claim 20, 21 or 22, wherein said movable member is openable and closeable with respect to a body of said apparatus.

* * * * *